US005634560A

United States Patent [19]

Phillips

[11] Patent Number: 5,634,560

[45] Date of Patent: Jun. 3, 1997

[54] HAIR IMPLEMENT STORAGE DEVICE

[76] Inventor: Valerie A. Phillips, 13950 Far Hills La., Dallas, Tex. 75240

[21] Appl. No.: 650,669

[22] Filed: May 20, 1996

Related U.S. Application Data

[63] Continuation of Ser. No. 427,134, Apr. 24, 1995, abandoned.

[51] Int. Cl.[6] ..... B65D 69/00; B65D 71/00; B65D 6/12

[52] U.S. Cl. ..... 206/581; 206/536; 206/804; 206/823; 206/229; 220/8

[58] Field of Search ..... 206/581, 229, 206/362.1, 362.2, 362.3, 804, 823, 536, 817; 312/205, 293.3; 220/8; 132/313, 317, 308, 286

[56] References Cited

U.S. PATENT DOCUMENTS

| | | | |
|---|---|---|---|
| 139,423 | 5/1873 | Rockwell . | |
| 750,632 | 1/1904 | Fisher | 220/8 X |
| 825,810 | 7/1906 | Cooke | 220/8 X |
| 1,155,447 | 10/1915 | Saunders | 206/804 X |
| 1,446,520 | 7/1923 | Smith . | |
| 1,566,860 | 12/1925 | Hainzigianis | 206/804 X |
| 1,833,541 | 11/1931 | Sierad et al. . | |
| 2,802,568 | 8/1957 | Knox | 206/65 |
| 2,868,361 | 1/1959 | Zilem et al. | 206/804 X |
| 2,965,109 | 12/1960 | Borah | 206/229 X |
| 3,275,133 | 9/1966 | Wood | 206/804 X |
| 3,759,377 | 9/1973 | Weimer | 206/65 |
| 3,838,680 | 10/1974 | Shipman | 220/8 X |
| 3,915,219 | 10/1975 | Wallace | 206/362 |
| 4,765,482 | 8/1988 | Delia | 206/804 X |
| 4,784,112 | 11/1988 | Hayashi | 220/8 X |
| 4,915,219 | 4/1990 | Ottimo | 206/209.1 |

*Primary Examiner*—M. D. Patterson
*Attorney, Agent, or Firm*—Harold Levine, Esq

[57] ABSTRACT

The invention is to a storage device for storing hair accessories such as a comb, brush, and/or a can of hair spray internal to the storage device. At the same time the outside of the storage device is used to store and display fabric covered elastic ponytail holders, known as scrunchies.

12 Claims, 5 Drawing Sheets

HAIR IMPLEMENT STORAGE DEVICE

This application is a continuation of application Ser. No. 08/427,134, filed Apr. 24, 1995, now abandoned.

FIELD OF THE INVENTION

This invention relates to a storage device for storing hair accessories, and for mounting and storing hair holding devices.

BACKGROUND OF THE INVENTION

Various devices are available or have been patented for holding personal items such as toothbrushes and combs. In respect to toothbrushes, U.S. Pat. No. 4,915,219 defines an apparatus for disinfecting toothbrushes. The apparatus is a container with chambers into which a disinfecting liquid is deposited along with a tooth brush. Such a container must be "water tight" in order to hold the liquid with out flowing the liquid out of the container. A similar receptacle is disclosed in U.S. Pat. No. 1,446,520.

A similar apparatus is disclosed in U.S. Pat. No. 1,833,541. The purpose of the apparatus in this patent is for holding a liquid for disinfecting a hair comb.

In each of the above cited patents, it is the intent to have a container that will hold a disinfecting liquid, and for disinfecting either a toothbrush or hair comb.

SUMMARY OF THE INVENTION

The invention is to a storage device for storing hair accessories such as a comb, brush, and/or a can of hair spray internal to the storage device. At the same time the outside of the storage device is used to store and display fabric covered elastic ponytail holders, known as scrunches. The holder can be covered with decorative fabrics, bright colored plastic material, wood, glass, or any other suitable attractive material depending on the user's taste and preference.

The storage device has a cylindrical body with a flared base to give it stability. A friction lid encloses the inside storage chamber. The lid is easily removed by grasping a loop handle on top of the lid.

A second embodiment includes a track guided rack inside the storage device which is lifted to raise the implements inside to a position to which they may be easily removed. The rack has guide pins that move in vertical tracks that have one or more offset positions. The guide pins may be moved, or rotated into the off set position to hold the rack at one or move levels.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
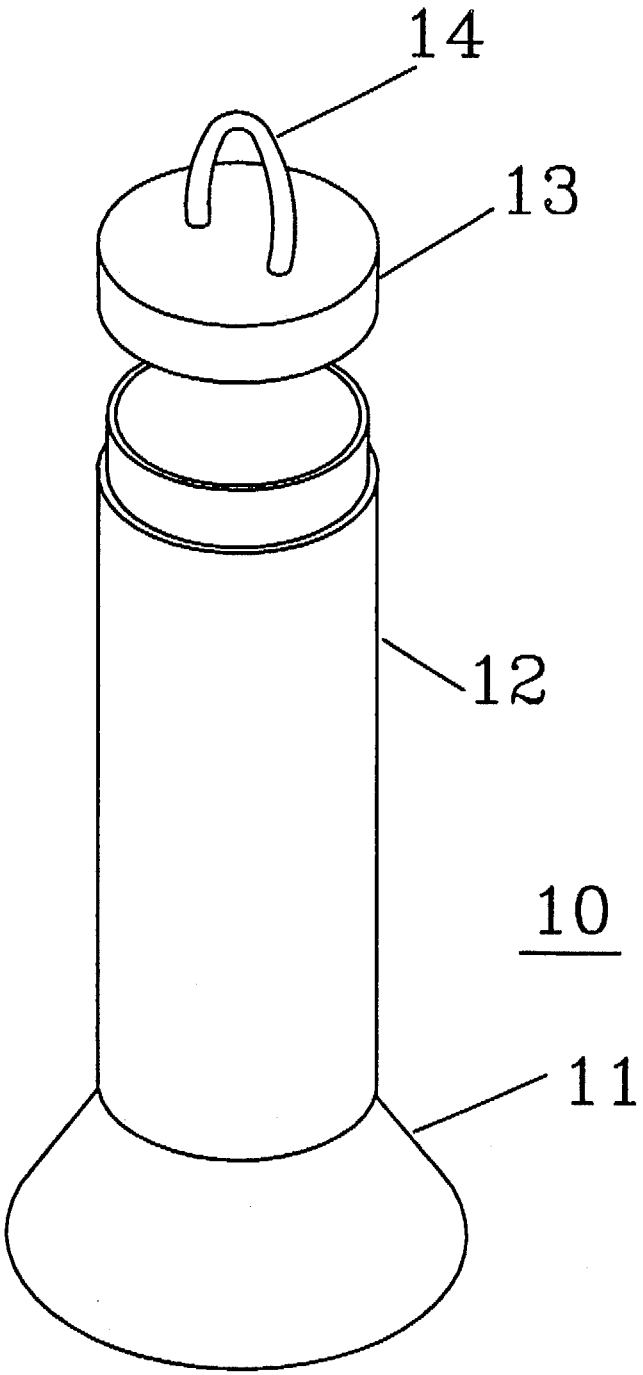
FIG. 1 shows the storage device of the invention.

FIG. 1 is an isometric view of the storage device 10. Device 10 has a cylindrical body 12 with a flared or conical base 11 that extends out from cylindrical body 12 to provide a stable base. A friction lid 13 closes body 12, and has a handle 14 for removing lid 13 from the top of body 12.

Figure 2:
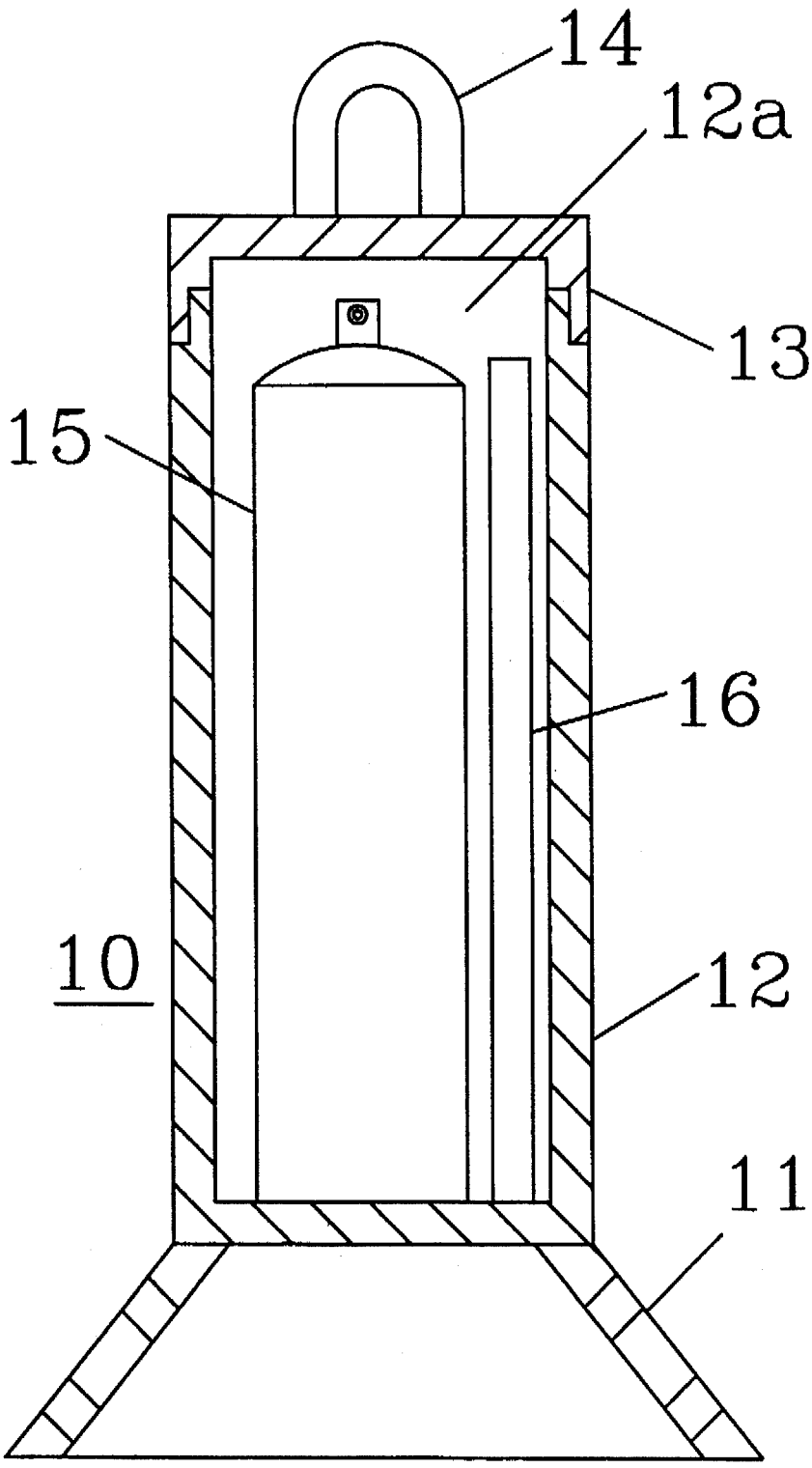
FIG. 2 is a cross-sectional view of the storage device of FIG. 1.

FIG. 2 is a cross-sectional view of storage device 10 showing body 12 in cross-section, revealing storage chamber **12*a*. Stored in chamber 12*a* is a comb 16 and an aerosol can 15 which may contain any one of various types of hair sprays. Spray can 15 and comb 16 are stored in storage device 10 when not in use. Various other articles may be store in device 10** such as hair brushes.

Figure 3:
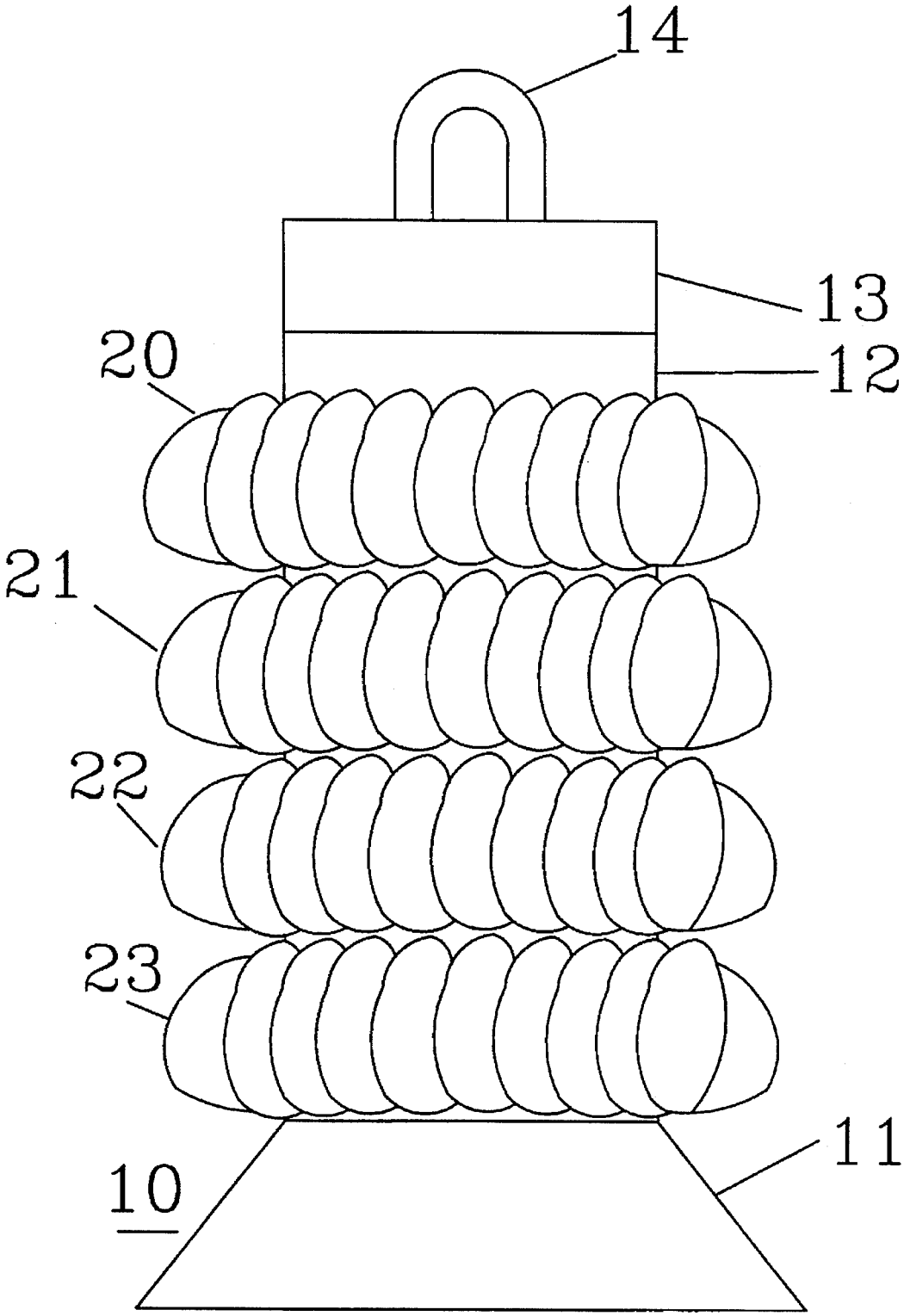
FIG. 3 shows the storage device with scrunches stored thereon.

FIG. 3 shows storage device 10 with a plurality of scrunches stored on the outside surface of body 12. Scrunches 20–23 are elastic bands that are covered with decorative cloth or ribbons. Crunches 20–23 are stretched to place them on the surface of body 12 while not in use, and then are removed as needed when arranging hair with the scrunches.

Figure 5:
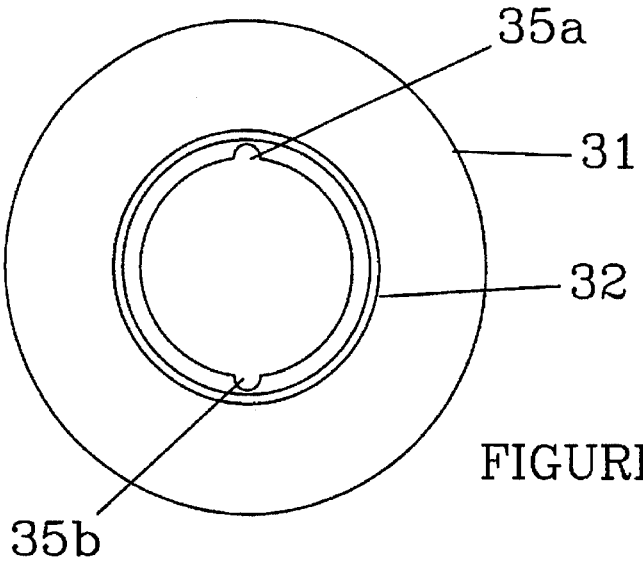
FIG. 5 is a top view of the storage device of FIG. 4 with lid removed.
Figure 4:
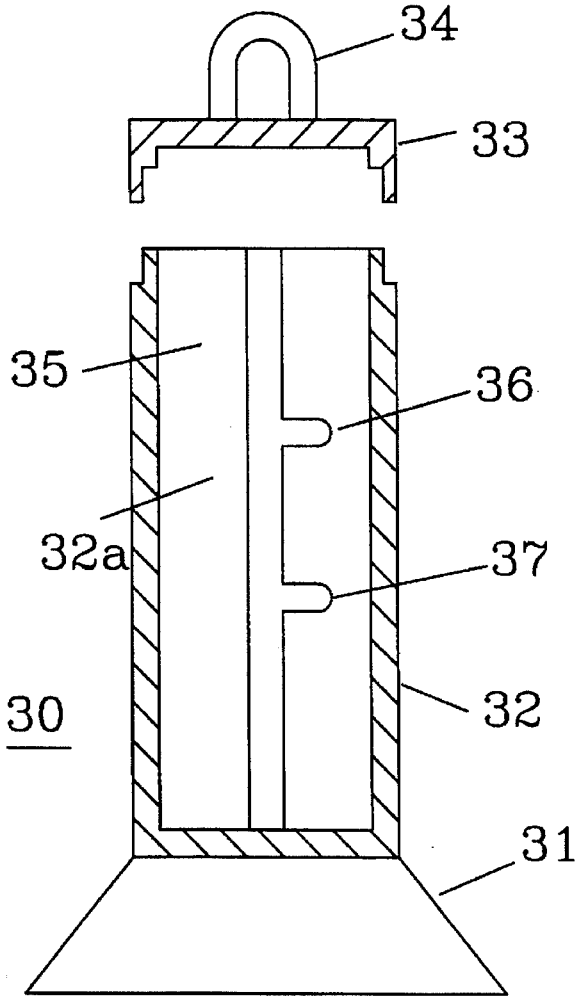
FIG. 4 is a cross-sectional view of a second embodiment of the invention.

FIG. 4 illustrates a second embodiment of storage device 30. Storage device 30 has a cylindrical body 32 on a conical base 31. In the inside wall 35 are two oppositely opposed vertical tracks or grooves **35*a* and 35*b*. FIG. 5 is a top view of storage device 30 showing vertical tracks 35*a* and 35*b*. There is one or more offset grooves (two illustrated) 36 and 37** for locking a rack, in which hair implements and spray may be placed, in a raised position.

Figure 6:
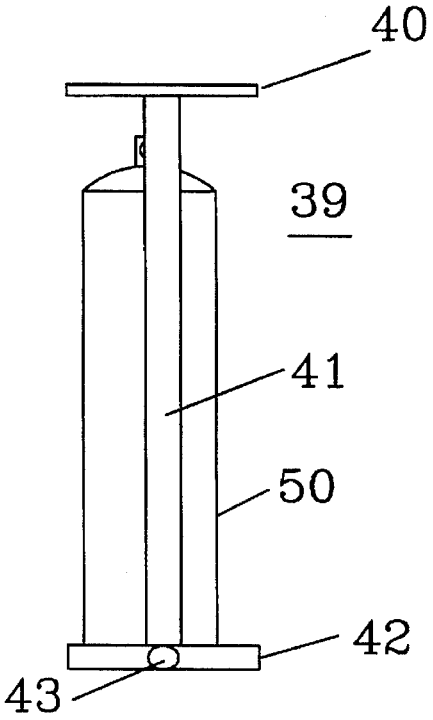
FIG. 6 shows a rack for use in the storage device of FIG. 4.
Figure 7:
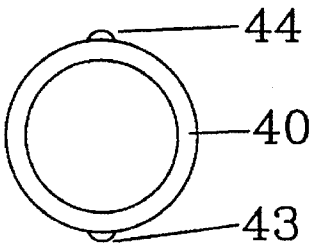
FIG. 7 is a top view of the rack of FIG. 6.

FIGS. 6 and 7 show a rack 39 having a top ring 40, a bottom base 42 and two side supports 41 (only one illustrated). In base 42 are guide pins 43 and 44 which move in tracks **35*a* and 35*b*. When rack 39 is positioned in storage device 30, guide pins 43 and 44 are in vertical tracks 35*a* and 35*b* and follow these tracks as rack 39 is lifted upward. To position rack 39 at an intermediate position in storage device 30, rack 39 is moved upward and then rotated when pins are adjacent, for example, offset grooves 37. With pins 43 and 44 in off set groves 37, rack 39 will remain in a partially raised position, permitting the hair implements and/or hair spray can 50 to be lifted out the rack 39** for use.

Figure 8:
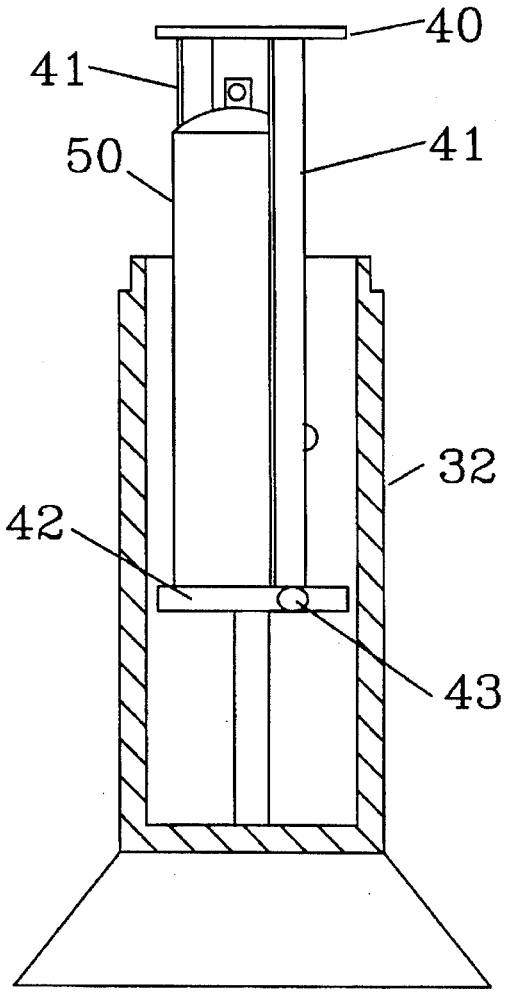
FIG. 8 shows the rack of FIG. 6 in a raised position.

FIG. 8 shows rack 39 in storage device 32 raised and locked in an intermediate position. If desired, rack 39 can be removed from storage device 32 completely. In a raised position, hair implements, as well as hair spray container 50, may be easily removed from storage device 32 for use. The use of rack 39 and the hair implements therein do not interfere the use of the outside surface of container 32 for storing scrunches or other elastic hair apparatus.

What is claimed:

1. A storage device for storing hair implements internal and external to the storage device; comprising a single hollow cylindrical body having a wall with first and second ends, said wall having an inside surface and a smooth outside surface;

a tapered base attached to and integral with said first end;

an opening in said second end forming an entrance to the hollow cylindrical body;

a pair of vertical tracks formed by indentions in the inside surface of the cylindrical wall;

a rack having a circular base member and a circular top member connected by two vertical supports, and a pair of pins extending from the base member, one pin each adjacent an end of a vertical support, and one each extending into one of the vertical tracks; and a cover for closing said opening.

2. The storage device according to claim 1, wherein said cylindrical body has an outer surface, between said first and second ends for storing, elastic hair fasteners.

3. The storage device according to claim 1, wherein said cover includes an inverted U-shaped handle for removing and placing said cover on said cylindrical body.

4. The storage device according to claim 1, wherein said tapered base extends from said cylindrical body having a first diameter to a circular base of a larger diameter.

5. The storage device according to claim 1, wherein said second end of said cylindrical body and said removable top have off-set walls complimentary to each other for mounting said top on said second end.

6. The storage device according to claim 1, wherein said inner surface of said wall has off-set tracks, joining said vertical tracks, into which said pins are moved to hold said rack in a raised position.

7. A storage device for storing hair implements; comprising:

a hollow cylindrical body having a wall with first and second ends, said wall having an inside surface and a smooth outside surface, including an offset in the outside surface of the second end;

a tapered base attached to and integral with said first end;

an opening in said second end forming an entrance to a storage chamber within the hollow cylindrical body;

a pair of vertical tracks formed by indentions in the inside surface of the cylindrical wall;

a rack having a circular base member and a circular top member connected by two vertical supports, and a pair of pins extending from the base member, one pin each adjacent an end of a vertical support, and one each extending into one of the vertical tracks; and a cover, including a circular inner wall having an offset, complementary to the offset in the outside surface of the second end, for closing said storage chamber.

8. The storage device according to claim 7, wherein said cylindrical body has an outer surface between said first and second ends for storing, elastic hair fasteners.

9. The storage device according to claim 7, wherein said cover includes an inverted U-shaped handle for removing and placing said cover on said cylindrical body.

10. The storage device according to claim 7, wherein said tapered base extends from said cylindrical body having a first diameter to a circular base of a larger diameter.

11. The storage device according to claim 7, wherein said inner surface of said wall has off-set tracks, joining said vertical tracks, into which said pins are moved to hold said rack in a raised position.

12. A storage device for storing hair implements; comprising:

a hollow cylindrical body having a wall with first and second ends, said wall having an inside surface and a smooth outside surface, including an offset in the outside surface of the second end;

a tapered base attached to and integral with said first end;

an opening in said second end forming an entrance to a storage chamber within the hollow cylindrical body;

a pair of vertical tracks formed by indentions in the inside surface of the cylindrical wall;

a rack having a circular base member and a circular top member connected by two vertical supports, and a pair of pins extending from the base member, one pin each adjacent an end of a vertical support, and one each extending into one of the vertical tracks; a a cover, including a circular inner wall having an offset, complementary to the offset in the outside surface of the second end, for closing said storage chamber; and an inverted U-shaped handle on said cover.

* * * * *